United States Patent [19]

Ogisu et al.

[11] 4,115,213

[45] Sep. 19, 1978

[54] ELECTRODEPOSITION PROCESS & APPARATUS

[75] Inventors: Kenji Ogisu; Masahisa Enomoto, both of Yokohama, Japan

[73] Assignee: Sony Corporation, Tokyo, Japan

[21] Appl. No.: 860,884

[22] Filed: Dec. 15, 1977

[30] Foreign Application Priority Data

Dec. 17, 1976 [JP] Japan ..... 51/152744

[51] Int. Cl.[2] ..... C25D 3/66; C25C 3/00

[52] U.S. Cl. ..... 204/39; 204/64 T; 204/274

[58] Field of Search ..... 204/64 T, 274, 39

[56] References Cited

U.S. PATENT DOCUMENTS 4,016,052 4/1977 Tokumoto et al. ..... 204/39

*Primary Examiner*—Howard S. Williams

*Attorney, Agent, or Firm*—Lewis H. Eslinger; Alvin Sinderbrand

[57] ABSTRACT

In a process for electrodeposition of a metal or alloy, there is provided in a fused salt electrolytic bath a rotary drum device comprising a relatively rotatable cooling drum and scraper, salt particles deposited on the surface of the cooling drum being scraped off within the bath and dispersed in the bath thereby to assist the production of a smooth and compact electrodeposit.

20 Claims, 2 Drawing Figures

ELECTRODEPOSITION PROCESS & APPARATUS

BACKGROUND OF THE INVENTION

1. Field of the Invention

The present invention relates to an electrodeposition process and particularly to an electrodeposition process suitable for large scale production of titanium or titanium alloy. The present invention also relates to an electrodeposition apparatus for carrying out the process.

2. Description of the Prior Art

To electrodeposit titanium or the like, we or our assignees have proposed various processes, such as disclosed in Japanese Pat. No. 726,754 and Japanese patent application Nos. 107500/1974, 131960/1974 and 65920/1976, wherein a fused salt electrolytic bath is used so that a metal or alloy is grown by electrodeposition with the surface of the deposit being kept flat, thereby obtaining a smooth and compact electrodeposit having a desired thickness. Particularly in Japanese patent application No. 131960/1974, we have proposed an electrodeposition process for obtaining a smooth and compact electrodeposit, in which solid particles are dispersed in a fused salt electrolytic bath so as effectively to act on an electrodeposition surface and enable stable electrodeposition to be maintained for a long period of time. The solid particles used in this process are normally powdery particles consisting of silicon dioxide, carbon or the like, which are either fed into the bath from outside, or are constituent salt particles deposited from the fused salt electrolyte.

However, when solid particles are fed into the bath from outside, the particles may be contaminated with impurities or oxidized, and cause a deterioration in the quality of the electrodeposit to occur or difficulties in maintaining the electrolysis over a prolonged period of time. When salt particles deposited from the fused salt electrolyte itself are used as the solid particles, these problems do not occur. In this case, however, there are difficulties in obtaining controlled deposition of salt particles, in particular of the required amount and particle size, stably and continuously in the fused salt electrolytic bath.

SUMMARY OF THE INVENTION

It is an object of the present invention to provide an electrodeposition process wherein solid particles of deposited salt are obtained from a fused salt electrolyte stably and continuously.

It is another object of the present invention to provide an electrodeposition process wherein a smooth and compact electrodeposit of high quality can be produced on a large scale.

It is another object of the present invention to provide an electrodeposition process wherein a device is used to produce solid particles of deposited salt from a fused salt electrolyte, the device also being used to control the electrolysis conditions.

According to the present invention there is provided a fused salt electrodeposition process wherein a rotary drum type device, which comprises a cooling drum and a scraping means associated with the cooling drum, is disposed in a fused electrolytic bath; salt particles deposited on the surface of the cooling drum are scraped off in the bath by the scraping means; and the salt particles so formed are dispersed and fluidized in the bath. In this process, deposited salt particles can be effectively formed and dispersed in the bath, so that a smooth and compact electrodeposit of good quality can be obtained in a mass-production or large scale manner.

According to the present invention there is also provided apparatus for performing the above process.

The above, and other objects, features and advantages of this invention will be apparent from the following detailed description of illustrative embodiments which is to be read in connection with the accompanying drawings.

DESCRIPTION OF THE PREFERRED EMBODIMENTS

A description will hereinafter be given with reference to the drawings of one embodiment of the present invention.

Figure 1:
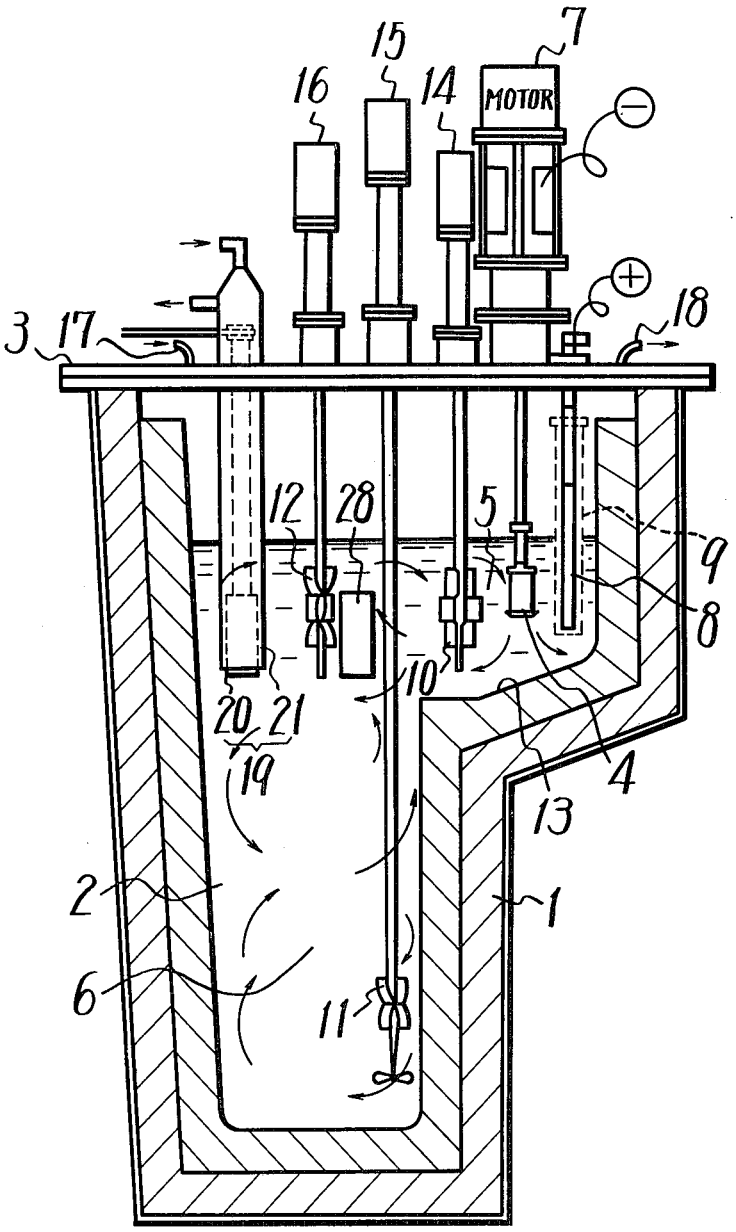
FIG. 1 is a cross-sectional view showing an example of an electrodeposition apparatus used in the present invention.

FIG. 1 shows an electrodeposition apparatus comprising an electrolytic cell 1 containing therein a fused salt electrolytic bath 2, and having a cover 3. When a metal such as titanium is to be electrodeposited, an electrolyte containing constituents such as $TiCl_2$, $TiCl_3$, $BaCl_2$, $MgCl_2$, $CaCl_2$, NaCl, KCl and the like can be used as the fused salt electrolytic bath 2. In the cell 1, the electrolytic bath 2 has a low temperature part 5 which is kept at an electrolytic temperature of, for example, 500° C or less, preferably in a range of 440° C to 480° C, with a rotary cathode 4 disposed therein; and a high temperature part 6 which is kept at a temperature high enough to fuse all the components of the electrolytic bath 2, for example, 500° C or more, preferably in a range of 520° C to 560° C. Suitable stirring means is provided in the electrolyte to produce annular flows forming generally closed loops in the low and high temperature parts 5 and 6, respectively, and also to form a flow generally circulating therebetween, as shown by arrows in FIG. 1. The cathode 4 is disposed within the low temperature part 5, for example downstream of the generally circulating flow of electrolyte. The cathode 4 is rotated or given a precessional motion by, for example, a motor 7. An anode 8 is disposed opposing the cathode 4. In the illustrated example, a screen 9 is provided around the anode 8 to prevent the components of the electrolyte from being affected by anode reaction products produced during the electrolytic operation.

The cell 1 has formed therein a sink portion on one side, in which is located the high temperature part 6. The portion over the high temperature part 6 and a shallow portion immediately adjacent thereto together provide the location for the low temperature part 5. The cathode 4 is disposed in the shallow portion of the low temperature part 5. The bottom 13 of the shallow portion is preferably inclined downwards towards the high temperature part 6. In order that the temperatures in the low and high temperature parts 5 and 6 may be adjusted to have required values by means of internal heaters or external heaters (not shown), two or more stirring devices 10, 11 and 12 such as propellers, helical screws or the like are provided in the electrolytic bath 2 to form the above-mentioned annular flows. Reference numerals 14, 15 and 16 denote motors for driving the stirring devices 10, 11 and 12, respectively. Air is excluded from the electrolytic bath 2 by providing an atmosphere of an inactive gas such as argon. An inlet port 17 and an outlet port 18 are provided for the inactive gas.

To permit operation in accordance with the present invention, a rotary drum type salt particle depositing device 19 is disposed in the electrolytic bath 2 to form and disperse therein deposited salt particles which serve as solid particles. The device 19 comprises a cooling drum 20 which is cooled by, for example, a flow of air, and a scraping means 21 disposed coaxially around the drum 20 so that deposited salt particles formed on the surface of the cooling drum 20 are scraped off and dispersed into the electrolytic bath 2 by relative rotation between the cooling drum 20 and the scraping means 21.

Figure 2:
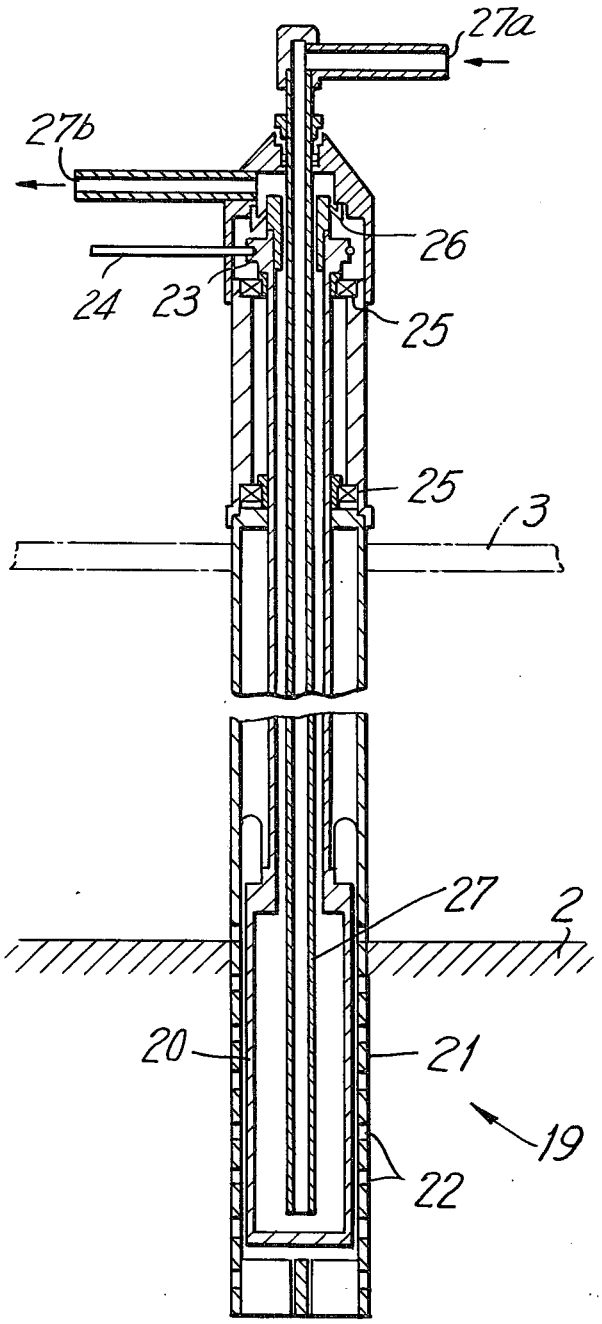
FIG. 2 is a cross-sectional view showing an example of a salt particle depositing device used in the apparatus of FIG. 1.

FIG. 2 shows the detailed construction of the salt particle depositing device 19. As shown in FIG. 2, the scraping means 21 is cylindrical and provided with a plurality of apertures 22 in the part of the side wall which is immersed in the electrolytic bath 2. A portion of the cooling drum 20 on which salt particles are to be deposited is located within the electrolytic bath 2 within and adjacent to the inner surface of the scraping means 21 with a predetermined distance maintained therebetween. The cooling drum 20 and the scraping means 21 are arranged for relative rotation. In the illustrated example, the scraping means 21 is fixed, while the cooling drum 20 is rotated by a motor (not shown) driving through a belt 24 and a pulley 23. A bearing 25 is provided between the cooling drum 20 and the scraping means 21, and above the pulley 23 is an oil seal 26. An air pipe 27 is disposed axially within the cooling drum 20. A flow of air is introduced from an inlet port **27*a* through the pipe 27 into the cooling drum 20 and discharged from an outlet port 27*b* to the atmosphere through a gap between the pipe 27 and the cooling drum 20. As mentioned above, the device 19 is disposed in the low temperature part 5 at the upstream side relative to the general flow in the electrolytic bath 2 (refer to FIG. 1**).

With the above construction of the device 19, the electrolyte can pass through the apertures 22 of the scraping means 21 to contact the surface of the cooling drum 20. Between the device 19 and the cathode 4 there is provided a screen-like separator 28 which may or may not have apertures therethrough.

In the above example, the cooling drum 20 is rotated, while the scraping means 21 is fixed. However, as alternatives, the cooling drum 20 may be fixed while the scraping means 21 is rotated, or both may be rotated in opposite directions.

With the salt particles depositing device 19 described above, if air is fed through the pipe 27 into the cooling drum 20, the drum surface in contact with the electrolytic bath 2 is cooled to cause deposition of salt particles on the drum surface. As the salt particles grow to predetermined sizes, they are continuously scraped off by the scraping means 21 as the cooling drum 20 is rotated, and the salt particles so scraped off are dispersed through apertures 22 into the bulk of electrolytic bath 2. The formation and dispersion of deposited salt particles are continuously carried out by the rotation of the cooling drum 20. The dispersed salt particles affect the electrodeposition on the surface of the cathode 4 and result in the electrodeposit having a smooth surface.

With the above-described device 19, the cooling of the cooling drum 20 is carried out by the introduction of air, so that the deposition temperature of the electrolyte 2 can be easily controlled by adjusting the amount and temperature of the air introduced. In addition to the adjustment of the amount and temperature of the air introduced, control of the speed of the relative rotation between the cooling drum 20 and the scraping means 21 results in an easy control of the amount of deposited salt particles to be dispersed into the electrolytic bath 2. The above speed control also permits control of the grain sizes of the salt particles. Moreover, the load on the motor for rotating the cooling drum 20 will depend on the growing state of deposited salt on the surface of the cooling drum 20. Accordingly, the growing state of deposited salt can be determined by sensing the torque of this motor.

With the described salt particle depositing device 19, the deposited salt particles produced can readily be controlled simply by controlling the temperatures at the air inlet and outlet ports **27*a* and 27*b* and the rotational speed of the cooling drum 20**.

As described above, deposited salt particles having no contamination can be stably, continuously and effectively obtained and dispersed in a fused salt electrolytic bath, so that a smooth and compact electrodeposit of high quality can be produced in quantity. As a result, the electrodeposition process of this invention is suitable for use in the electrodeposition of, for example, titanium or titanium alloy.

Although illustrative embodiments of the invention have been described in detail herein with reference to the accompanying drawings, it is to be understood that the invention is not limited to those precise embodiments, and that various changes and modifications can be effected therein by one skilled in the art without departing from the scope and spirit of the invention as defined by the appended claims.

We claim:

1. An electrodeposition process comprising the steps of:

(a) preparing a fused salt electrolytic bath containing a salt of a metal to be electrodeposited or of constituent metals of an alloy to be electrodeposited;

(b) providing cathode and anode electrodes within said electrolytic bath;

(c) providing a cooling drum within said electrolytic bath for deposition of solid particles of said salt thereon;

(d) scraping the solid salt particles deposited on the surface of said cooling drum off said cooling drum;

(e) dispersing said salt particles scraped off said cooling drum throughout said electrolytic bath; and (f) electrodepositing the desired metal or alloy on said cathode electrode from said electrolytic bath containing dispersed said salt particles therein.

2. An electrodeposition process according to claim 1 wherein a scraping means is moved relative to said surface of said cooling drum to scrape off said salt particles deposited thereon.

3. An electrodeposition process according to claim 2 wherein said salt particles deposited on said cooling drum are scraped off by relative rotation between said cooling drum and said scraping means.

4. An electrodeposition process according to claim 1 wherein said fused salt electrolytic bath contains at least a salt of barium, magnesium, potassium, calcium, sodium and titanium.

5. An electrodeposition process according to claim 1 carried out in an electrolytic cell.

6. An electrodeposition process according to claim 5 wherein said electrolytic bath in said electrolytic cell comprises a relatively low temperature part and a relatively high temperature part.

7. An electrodeposition process according to claim 6 wherein said cathode and anode electrodes, said cooling drum and said scraping means are all disposed in said low temperature part of said electrolytic bath, with said cathode electrode disposed between said anode electrode and said cooling drum.

8. An electrodeposition process according to claim 6 wherein said low temperature part of said electrolytic bath is kept at a temperature below 500° C, preferably in a range between 440° C and 480° C.

9. An electrodeposition process according to claim 6 wherein said high temperature part of said electrolytic bath is kept at a temperature above 500° C, preferably in a range between 520° C and 560° C.

10. An electrodeposition process according to claim 9 wherein the temperature of said high temperature part of said electrolytic bath is sufficient to fuse all the components of said electrolytic bath.

11. An apparatus for effecting electrodeposition of a metal, comprising:

(a) an electrolytic cell for containing a fused salt electrolytic bath containing a salt of a metal to be electrodeposited or of constituent metals of an alloy to be electrodeposited;
(b) cathode and anode electrodes within said electrolytic cell;
(c) a cooling drum within said electrolytic cell for deposition of solid particles of said salt thereon;
(d) scraping means for scraping the solid salt particles deposited on the surface of said cooling drum off said cooling drum; and
(e) means for dispersing said salt particles scraped off said cooling drum throughout said electrolytic bath.

12. An electrodeposition apparatus according to claim 11 wherein said scraping means is arranged to be moved relative to said surface of said cooling drum to scrape off said salt particles deposited thereon.

13. An electrodeposition apparatus according to claim 12 wherein said relative movement is relative rotation.

14. An electrodeposition apparatus according to claim 13 further comprising a motor to effect said relative rotation between said scraping means and said surface of said cooling drum, and means to sense the torque of said motor.

15. An electrodeposition apparatus according to claim 11 further comprising means to maintain part of said electrolytic bath in said electrolytic cell at a relatively low temperature and another part of said electrolytic bath in said electrolytic cell at a relatively high temperature.

16. An electrodeposition apparatus according to claim 15 wherein said cathode and anode electrodes, said cooling drum and said scraping means are all adapted to be disposed in said low temperature part of said electrolytic bath, with said cathode electrode disposed between said anode electrode and said cooling drum.

17. An electrodeposition apparatus according to claim 11 wherein said cooling drum is rotatable and said scraping means is fixed.

18. An electrodeposition apparatus according to claim 11 wherein said cooling drum is fixed and said scraping means is rotatable.

19. An electrodeposition apparatus according to claim 18 wherein said scraping means is provided with a plurality of apertures in a side wall thereof which is adapted to be immersed in said electrolytic bath.

20. An electrodeposition apparatus according to claim 11 further comprising means for supplying a flow of air through the interior of said cooling drum to cool said surface of said cooling drum.

* * * * *